United States Patent [19]

Karlas

[11] Patent Number: 4,824,101

[45] Date of Patent: Apr. 25, 1989

[54] SPRING BOARD

[76] Inventor: Hermanus L. J. Karlas, Spoorstraat 6, 3743 EG Baarn, Netherlands

[21] Appl. No.: 153,138

[22] Filed: Feb. 8, 1988

[51] Int. Cl.[4] ..... A63B 5/08; E04C 3/30

[52] U.S. Cl. ..... 272/66; 52/729

[58] Field of Search ..... 272/66, 65, 109, 93; 52/729, 730, 731, 732, 735, 802, 807; 428/166

[56] References Cited

U.S. PATENT DOCUMENTS 993,242 5/1911 Grey ..... 52/729

3,408,069 10/1968 Lewis ..... 272/66

FOREIGN PATENT DOCUMENTS 945293 12/1963 United Kingdom ..... 272/66

OTHER PUBLICATIONS

Mark's Handbook for Mechanical Engineers—8th Edition, ©1978, McGraw Hill, chapter 12, pp. 12-35 to 12-38.

*Primary Examiner*—Richard J. Apley

*Assistant Examiner*—S. R. Crow

*Attorney, Agent, or Firm*—Lorusso & Loud

[57] ABSTRACT

A spring board is provided with an upper plate, a lower plate and interposed flanged profiles. For obtaining an optimal adaption of the spring board's shape to the local strains the local cross-section area of the flanges of the profiles varies along the length of said profiles. In a preferred embodiment of the invention the width of the flanges varies along the length of the profiles thereby producing a spring board having a constant parallel distance between the upper and lower plates and having the necessary varied moments of inertia along the spring board length.

8 Claims, 2 Drawing Sheets

SPRING BOARD

BACKGROUND OF THE INVENTION

The invention generally relates to constructive elements, especially for carrying flexural and torsional loads.

An example of such a constructive element is formed by a diving board in which substantial flexural strains can develop especially when used by a professional competition diver. Torsional strains can occur when the take-off at the free end of the diving board is off-set.

The mentioned flexural strains generally vary along the length of said constructive elements so that too the moment of inertia of the constructive elements will vary along their length for obtaining a uniform stress level. Therefore in constructive elements mainly comprising an upper plate, a slightly spaced lower plate and a number of profiles extending longitudinally between said plates and connecting these, the height of these profiles or the thickness of the upper and lower plates, respectively, is varied. The provision of profiles varying in height and plates varying in thickness, respectively, leads to a constructive element having non-uniformal cross-sectional dimensions and that is expensive in its fabrication. Moreover constructive elements of this kind are known, especially diving boards, only comprising an upper plate and profiles mounted there below. The profiles are rather thick and the diving board has a high weight whereas the torsional stiffness is low.

Accordingly it is the object of this invention to improve the prior art constructive elements by providing a constructive element of which the moment of inertia is varied along its length without changing its cross-sectional dimensions along its length.

Further it is the object of this invention to provide a constructive element that can be fabricated simply and with low costs.

SUMMARY OF THE INVENTION

According to the invention a constructive element is provided with an upper plate, a slightly spaced lower plate and a number of profiles extending longitudinally between said plates and connecting these, said profiles at their upper and lower sides comprising flanges that extend in parallel with the plates and that are connected therewith, wherein the profile height of each profile remains constant along the length of the profile, whereas the cross-sectional area of the flanges varies along the length of the profiles. By varying the cross-sectional area of the flanges the moment of inertia of the constructive element can be varied without changing its cross-sectional dimensions. As a result an optimal adaptation to the requirements can be obtained by a minimal weight. If the constructive element is a diving board a weight reduction of about 35 percent is possible.

Other features and advantages of the invention will become apparent during the course of the following description.

BRIEF DESCRIPTION OF DRAWING FIGURES

DETAILED DESCRIPTION

Figure 1:
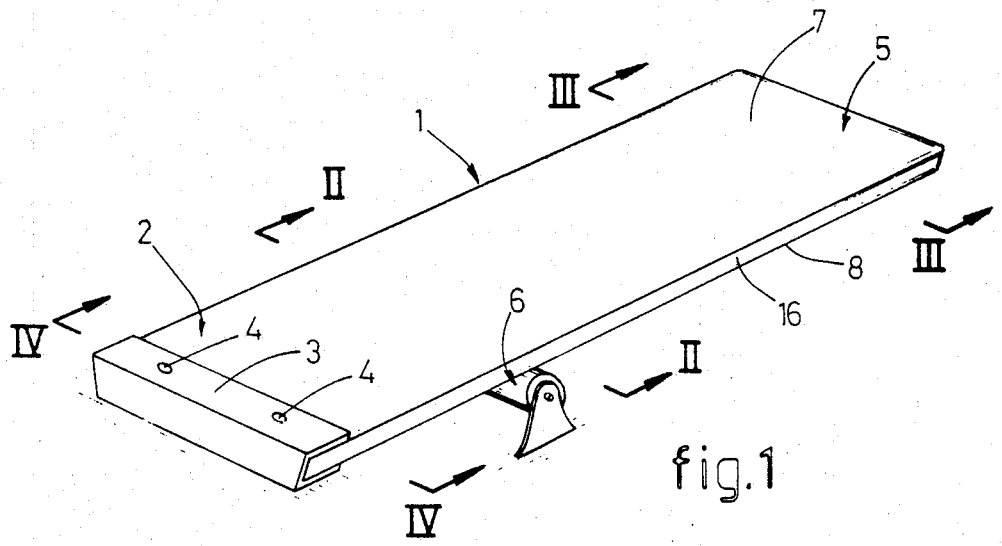
FIG. 1 is a perspective view of a diving board embodying the invention.

In FIG. 1 a diving board 1 is represented with a rearward end 2 that is fixedly mounted by means of a U-shaped bracket 3, that encloses the rearward end, and mounting bolts 4 that are connected to a fixed, not shown, base. The forward end 5 of the diving board 1 is cantilevered in a way known. At an appropriate location between the rearward end 2 and the forward end 5 the diving board is supported by a roller support 6 offering the diving board 1 the desired resiliency.

The diving board 1 shown in FIG. 1 is subjected to considerable loads, especially tensional and compressive strains due to bending moments. These tensional and compressive strains vary along the length of this diving board. At the forward end 5 these strains are minimal, whereas at the roller support 6 generally the highest strains will occur. Due to the said variation in strain the moment of inertia of the diving board does not have to be the same at each cross-section, for this would lead to a relative high weight, but the said moment of inertia has to be maximal at the roller support 6 and minimal at the forward end 5.

Figure 2:
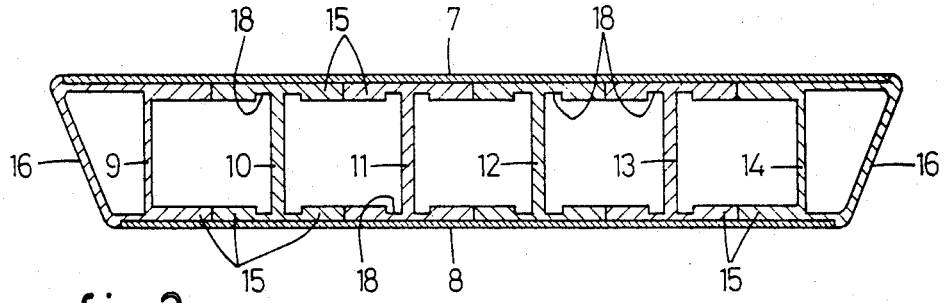
FIG. 2 is an enlarged vertical section taken on line II—II of fig.1.

FIG. 2 shows a cross-section taken on line II—II of FIG. 1. As appears the diving board essentially comprises an upper plate 7, a lower plate 8 and a number of profiles 9–14 extending longitudinally between said plates 7 and 8. The profiles 9–14 connect the upper plate 7 with the lower plate 8. At their upper and lower sides the profiles are provided with flanges 15 through which the profiles 9–14 are connected with the upper plate 7 and lower plate 8, respectively. Advantageously an adhesive is interposed between the flanges 15 and the plates 7 and 8. Alternatively it is possible to use rivets. In the longitudinal direction of the diving board 1 the plates 7 and 8 have a constant thickness.

It further appears from FIG. 2 that the upper plate 7 is wider than the lower plate 8. The profiles 9 and 14 that are interposed between said plates 7 and 8 at the side edges thereof comprise special edge profiles that each comprise an outwardly directed face 16 substantially connecting the corresponding side edges of the upper plate 7 and lower plate 8. In the embodiment shown these faces 16 smoothly join the upper plate 7 and lower plate 8. The resulting trapezoidal cross-section of the diving board offers the diving board an esthetic appearance whereas the risk of injuries is lowered. At the forward end 5 the diving board too can have such an inclinede shape.

Figure 3:
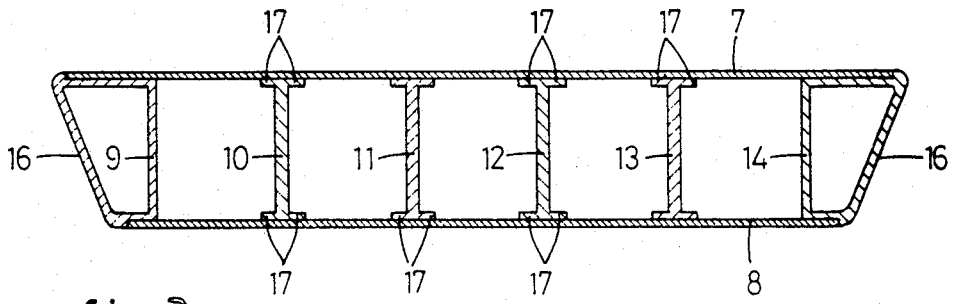
FIG. 3 is an enlarged vertical section on line III—III of FIG. 1.

At the section II—II, illustrated in FIG. 2, the diving board 1 has a large moment of inertia, especially due to the extended cross-sectional area of the flanges 15 that are interconnected. The dimensions of the flanges 15 are chosen such that the maximal strain level at the section II—II has an acceptable value. As appears from FIG. 3 the diving board 1 has at the low-loaded forward end 5 (section III—III) a lower moment of inertia because the total cross-sectional area of the profiles 9–14 is lower than it is in FIG. 2. The flanges 15 have at the section illustrated in FIG. 3 a considerably smaller width whereby only a small part 17 of the flanges 15, near to the remaining portion of the flanges, is maintained. Said maintained flange portions are necessary for the connection between the profiles 9–14 and the upper plate 7 and the lower plate 8. Because these maintained flange portions 17 are not necessary for obtaining a sufficiently large moment of inertia due to the low strain level, these portions have a moderate thickness. This appears as reduced portions 18 in FIG. 2.

The transition of section II—II (FIG. 2) to section III—III (FIG. 3) is a gradual one wherein the width of the flanges 15 is reduced gradually. At the same time the height of the profiles 9–14, thus the distance between the upper plate 7 and lower plate 8 does not vary.

Instead of a reduction of the width of the flanges 15 it is possible too to let diminish the thickness thereof. In such a case the flanges 15 of adjacent profiles 9–14 can constantly contact each other.

Figure 4:
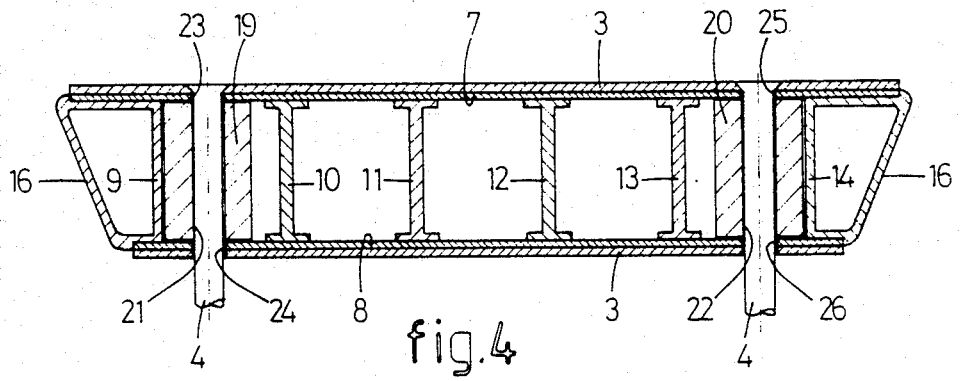
FIG. 4 is an enlarged vertical section taken on line IV—IV of FIG. 1.
Figure 5:
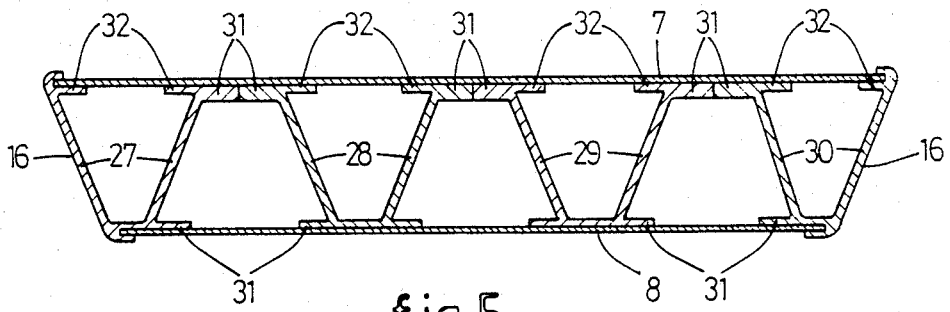
FIG. 5 is an alternative vertical section corresponding with the vertical section in FIG. 2.
Figure 6:
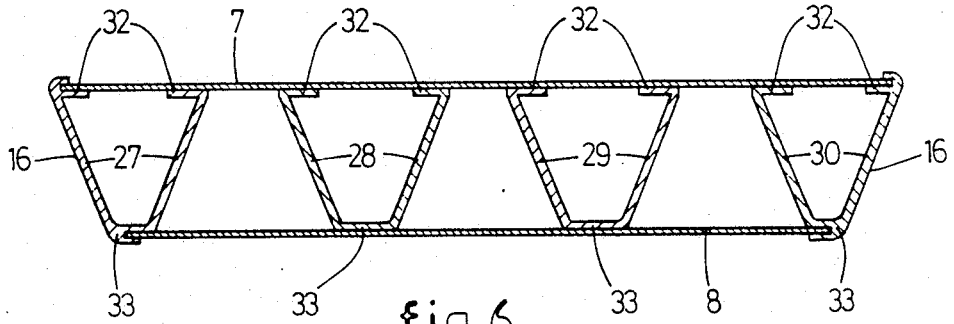
FIG. 6 is an alternative vertical section corresponding with the vertical section in FIG. 3.

FIG. 4 shows a section of the diving board 1 at the U-shaped bracket 3 and the mounting bolts 4. Between the profiles 9 and 10 and between the profiles 13 and 14 blocks 19 and 20, for example of aluminum, are positioned that are provided with bores 21 and 22 that are aligned with openings 23, 24 and 25, 26, respectively, in the upper plate 7 and the lower plate 8. In the U-shaped bracket 3 also some openings are provided that will be aligned with the said bores 21, 22 and the openings 23, 24, 25, 26 when the bracket 3 is mounted over the rearward end 2 of the diving board 1. Next the mounting bolts 4 are pushed through the mentioned openings and bores and are attached on a base not shown further, so that the rearward end 2 of the diving board 1 is fixed Instead of the I-profiles 9–14 shown in the FIG. 2–4 it is of course possible to choose other profile shapes. FIG. 5 and FIG. 6 show examples thereof. FIG. 5 shows a section corresponding with II—II of FIG. 1 whereas FIG. 6 shows a section corresponding with III—III in FIG. 1. Again clearly visible are profiles 27–30 that are provided with flanges 31 and 32. Starting with FIG. 5 the flanges 31 gradually disappear until they have disappeared totally (FIG. 6); the flanges 32 are maintained for the connection between the profiles 27–30 and the upper plate 7. The connection between the profiles 27–30 and the lower plate 8 occurs through a base 33 of the profiles 27–30 (FIG. 6).

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A spring board which can be fixed at its rearward end, and supported by a fulcrum to leave its forward end free to move, comprising:

an upper plate defining a first inner and a first outer surface;

a lower plate defining a second inner and a second outer surface and positioned a specific distance below and parallel to said upper plate such that said first inner surface and said second inner surface face one another while said first outer surface and said second outer surface face away from one another, said upper and lower plates being in essentially parallel planes; and a plurality of profiles extending longitudinally between and fixedly connecting said plates to form the spring board, each of said profiles having an upper end with an upper end flange which contacts and is fixed to said first inner surface and a lower end with a lower end flange which contacts and is fixed to said second inner surface, said upper end flange extending parallel to said first inner surface and said lower end flange extending parallel to said second inner surface, said profiles maintaining a constant parallel distance between said upper and lower plates along the entire length of the spring board, the cross sectional area of said upper and lower end flanges varying, so that the cross sectional areas of the upper and lower flanges along the length of the spring board's longitudinal axis are greater at that point corresponding to the point at which the spring board is supported by the fulcrum then the cross sectional areas of the flanges at the forward free end of the spring board so that the spring board has a higher moment of inertia at the point at which is supported by the fulcrum than it has at its forward free end while maintaining a constant thickness along its entire length.

2. The spring board as set forth in claim 1, further comprising an adhesive arranged as a connection means between said upper and lower end flanges of said profiles and said first inner surface and said second inner surface respectively.

3. The springboard as set forth in claim 11, wherein the width of the flanges varies along the length of the profiles.

4. The spring board as set forth in claim 1, wherein the thickness of the plates remains constant along the length of a profile.

5. The spring board as set forth in claim 1, wherein the upper plate, as seen in a direction transverse to the longitudinal orientation of the profiles, is larger than the lower plate while the upper and lower plates end in side edges that extend parallel to the longitudinal orientation of the profiles and perpendicular to said first and second inner and outer surfaces, wherein between the corresponding side edges of the upper and lower plates, respective edge profiles are provided that each comprise an outwardly directed face substantially connecting the corresponding side edges of the upper and lower plates.

6. The spring board as set forth in claim 1, wherein at least some of the profiles comprise a narrowing portion at the transition between the flange and the remaining profile section.

7. The spring board as set forth in claim 1, wherein at least some of the profiles comprise I-profiles.

8. The spring board as set forth in claim 1, wherein at least some of the flanges of adjacent profiles are locally contacting each other.

* * * * *